US006205609B1

(12) United States Patent
Sajakorpi et al.

(10) Patent No.: US 6,205,609 B1
(45) Date of Patent: Mar. 27, 2001

(54) BRUSH RING

(75) Inventors: Kimmo Sajakorpi; Reijo Kuivikko, both of Tampere (FI)

(73) Assignee: Sajakorpi Oy, Tampere (FI)

( * ) Notice: Subject to any disclaimer, the term of this patent is extended or adjusted under 35 U.S.C. 154(b) by 0 days.

(21) Appl. No.: 09/011,524

(22) PCT Filed: Aug. 21, 1997

(86) PCT No.: PCT/FI97/00486

§ 371 Date: May 6, 1998

§ 102(e) Date: May 6, 1998

(87) PCT Pub. No.: WO98/09551

PCT Pub. Date: Mar. 12, 1998

(30) Foreign Application Priority Data

Sep. 3, 1996 (FI) ..... 963433

(51) Int. Cl.[7] ..... A46B 1/00
(52) U.S. Cl. ..... 15/181; 15/82
(58) Field of Search ..... 15/82, 179, 181

(56) References Cited

U.S. PATENT DOCUMENTS

| | | | | |
|---|---|---|---|---|
| 2,320,384 | * | 6/1943 | Peterson | 15/181 |
| 3,038,189 | * | 6/1962 | Harr | 15/181 |
| 3,090,062 | * | 5/1963 | Nelson | 15/181 |
| 3,274,634 | * | 9/1966 | Godfrey | 15/181 |
| 3,490,087 | | 1/1970 | Krier et al. . | |
| 4,998,316 | | 3/1991 | Maltarp . | |
| 5,588,172 | | 12/1996 | Biocca . | |
| 5,605,383 | | 2/1997 | Biocca . | |
| 5,784,748 | * | 7/1998 | Belanger et al. | 15/230.16 |

FOREIGN PATENT DOCUMENTS

| | | |
|---|---|---|
| 39 14 745 A1 | 11/1989 | (DE) . |
| 0 021 609 | 1/1981 | (EP) . |
| 0 021 609 A1 | 1/1981 | (EP) . |
| 40453 | 11/1969 | (FI) . |
| 2140/70 | 10/1974 | (FI) . |
| 87977 | 12/1992 | (FI) . |

* cited by examiner

*Primary Examiner*—Terrence R. Till
(74) *Attorney, Agent, or Firm*—Connolly Bove Lodge & Hutz

(57) ABSTRACT

A brush ring, intended to be used particularly with several corresponding brush rings as a brush that rotates around a longitudinal axis in a brushing machine is provided. The brush ring consists of a brush part and a ring shaped frame part, that connects the radially directed brushes forming the brush part. These parts are formed as a common unit entirety preferably from plastic based material. A holding device is provided to prevent the brush ring from twisting, when it has been assembled in place to the brush frame of the brushing machine with the other brush rings placed one after another in the longitudinal direction. The touching point of the radially directed outer circle of the brush part of the brush ring has been arranged to change within the whole breadth of the brush ring, to achieve an essentially unbroken brush touch in the longitudinal direction of the brushing machine to the object being brushed continuously regardless of the length of the brushes, when the brush rings forming the brush keep rotating around the longitudinal axis.

10 Claims, 4 Drawing Sheets

BRUSH RING

FIELD OF THE INVENTION

The present invention relates to a brush ring, intended to be used particularly with several corresponding brush rings as a brush that rotates around a longitudinal axis in a brushing machine. Such a brush ring consists of a brush part and a ring shaped frame part, connecting the radially directed brushes forming the brush part, which parts are formed as a uniform entirety preferably from plastic based material, and in which there has been arranged at least a holding means to prevent the brush ring from twisting, when it has been assembled in place to the brush frame of the brushing machine with the other brush rings placed one after another in the longitudinal direction. The touching point of the radially directed outer circle of the brush part of the brush ring has been arranged as to change within the whole breadth of the brush ring, to achieve an essentially unbroken brush touch in the longitudinal direction of the brushing machine to the object being brushed continuously regardless of the length of the brushes, when the brush rings forming the brush keep rotating around the longitudinal axis.

BACKGROUND OF THE INVENTION

These type brush rings described above are being used to form brushes in most heterogeneous sweeping lorries and brushing machines. The brush rings being used today usually comprise a ring shaped frame part that has been bent to a circumferential shape, when viewed in a perpendicular direction with respect to the longitudinal direction of the brushes, and is usually made of thin sheet iron, the thickness of which is e.g. about 1 mm and in which the brushes have been attached e.g. by means of suitable solidifying attachment mass. These type of brush rings are usually plane shaped, when viewed in the longitudinal direction of the brushes, when the aim is to produce brushes having a particularly good quality.

Those type brush rings, that are partly made of metal, tend to break particularly because of cold conditions, due to stiffening of the brushes. As a result, the sheet iron frame supporting the brush part of the brush ring may open in certain places, in which case bigger or smaller units of brush parts are released from the brush ring. In addition to that, in the type of brush rings described above having metal frames and plastic brushes, that reuse of the same is impossible in practice, because removing of the frame sheet iron from the brushes is not economically justified in practice. That is why these brush rings are removed as a whole to the dumping area, creating a significant waste problem. Furthermore, when brush rings described above, are being used, very strongly built supporting structures must be used, such as space rings made of metal, fastening rings etc., which is why a brush made with these kinds of brush rings becomes disproportionately expensive.

On the other hand from Finnish Patent No. 87977, a brush element is previously known, that is entirely made of plastic based material. The brush elements being produced by the method described in this patent, are plane shaped, when viewed in the longitudinal direction of the brushes, and due to wearing of the brushes, the brushing of the brush formed of the brush rings becomes uncontinuous in the longitudinal direction of the brush particularly in the jointing points of the brush rings. As a result, the brush is not able to fulfil conventional demands, that are needed in certain purposes, because material to be brushed may go through the brush without touching the brushes, in which case the brush must be dismantled and the brush rings of the same replaced.

On the other hand solutions corresponding to a certain extent to the brush ring described above have been presented in documents FI 40453, DE 39 14 745 and FI 2140/70, also, whereby in the two formerly mentioned documents there has been presented a brush ring that extends sidewards in a so called zig-zag style, but in both of which the actual frame part of the brush ring is formed as a metal structure e.g. from injection molded aluminium (FI 40453) or bent sheet iron (DE 39 14 745). Thus neither of the above enables an entirely recyclable and reusable entirety, which fact has a crucial meaning particularly nowadays. Additionally, the type of solutions described above are very complicated, that is why manufacturing costs of the same are disproportionately high. With the type of solutions in question it is not possible to reach an adequate measuring precision, which weakens functioning of the brush formed of the brush rings and shortens its operating time. The solution presented in document FI 2140/70 differs very clearly from the above, which does not describe the frame part and the brush part of the brush ring made of the same recyclable material. In addition to that, in this solution separate metal sockets to be bent in shape are requested for attachment of the brushes to the frame part as well as binding plates placed on both sides of the actual frame part. In this solution the frame part does not either include an essentially circumferential frame part, when viewed in a perpendicular direction with respect to the longitudinal direction of the brushes, but instead an actual rotating center and a circle part connected to the same with radially directed ribs.

SUMMARY OF THE INVENTION

It is the aim of the brush ring according to this invention to achieve a decisive improvement in the problems presented above and thus to raise substantially the level of knowledge in the field. To achieve this aim, the brush ring according to an embodiment of the invention is primarily characterized in, that the brush ring, such as the brush part and the frame part, is entirely made of recyclable, and preferably the same, manufacturing material, such as polypropylene or the like, and, the frame part, that is essentially circumferential, when viewed in a perpendicular direction with respect to the longitudinal direction of the brushes of the brush ring, has been arranged to project in at least two places sidewardly from the ground level of the same, preferably with a constant wave form.

As the most important advantages of the brush ring according to the invention simplicity and reliability of construction and use of the same may be mentioned. In addition to that, with the present invention, it is possible to produce brush rings, at the low manufacturing cost and at the same time having a higher quality than present brush rings. With the present invention the brushing result stays optimal with a view to the brushing effect significantly longer than with present brushes despite wearing of the brushes, that is in principle till the end of the brushes. In addition to that, the brush ring according to the invention brings also has economical advantages with respect to present solutions, since collecting of the brush out of brush rings according to the invention does not require supplementary auxiliary devices, that is why no supplementary measures are required during mounting. The brush ring according to the invention may be made very environmentally friendly by producing both the frame part and the brush part essentially from the same plastic based material, in which case reuse of the brush ring is enabled easily by e.g. grinding the entire used brush ring into pieces. When exploiting advantageous manufacturing techniques, the brush ring according to the invention may made very exactly measured as well as well-balanced, when compared particularly to present corresponding brush rings, in which unbalance wears the brush unevenly and thus also the brushing machine e.g. due to vibration. The brush rings being placed according to the invention directly against each other one after another, are furthermore in contact with each other e.g. by means of partly plane shaped contact surfaces, in which case the brush rings may not "swing" with respect to each other as is the case with present brush rings.

BRIEF DESCRIPTION OF THE DRAWINGS

In the following description, the invention is illustrated in greater detail with reference to the appended drawings. In the drawings.

DETAILED DESCRIPTION OF THE PREFERRED EMBODIMENT(S)

The invention relates to a brush ring, intended to be used particularly with several corresponding brush rings as a brush that rotates w around a longitudinal axis s in a brushing machine. This brush ring consists of a brush part 1 and a ring shaped frame part 2, that connects the radially directed r brushes 1*a* forming the brush part 1, which parts 1, 2 are formed as a single piece preferably from plastic based material, and in which there has been arranged at least holding means 3 to prevent the brush ring from twisting, when the same has been assembled in place to the brush frame of the brushing machine with the other brush rings placed one after another in the longitudinal direction s.

The touching point K of the radially directed r outer circle u of the brush part 1 of the brush ring has been arranged known as such to change within the whole breadth L of the brush ring, to achieve an essentially unbroken brush touch in the longitudinal direction s of the brushing machine to the object being brushed continuously regardless of the length of the brushes 1*a*, when the brush rings forming the brush keep rotating w around the longitudinal axis s. The brush ring, such as the brush part 1 and the frame part 2, is entirely made of recyclable and preferably the same manufacturing material, such as polypropylene or the like. Furthermore the frame part 2, that is essentially circumferential, when viewed in a perpendicular direction with respect to the longitudinal direction r of the brushes of the brush ring, has been arranged to project in at least two places x sidewardly from the ground level o of the same, preferably with a constant wave form. In the presented embodiments the holding means 3 are formed of one or several shoulder arrangements 3*a* to couple to brush ring untwistedly against the corresponding counterpart surface existing in the brush frame of the brushing machine.

Figure 1A:
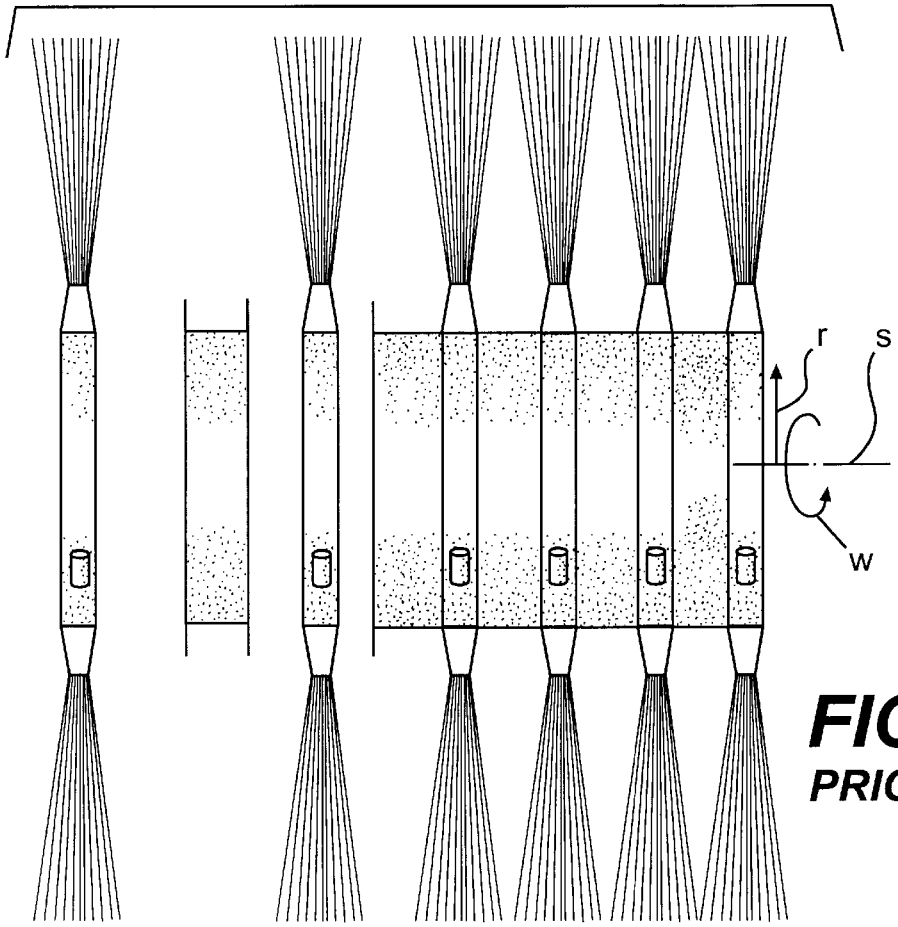
FIG. 1a PRIOR ART
FIGS. 1*a* and 1*b* show sectional sideviews of a brush formed of conventional brush rings as slightly used a) and as significantly used b)
Figure 1B:
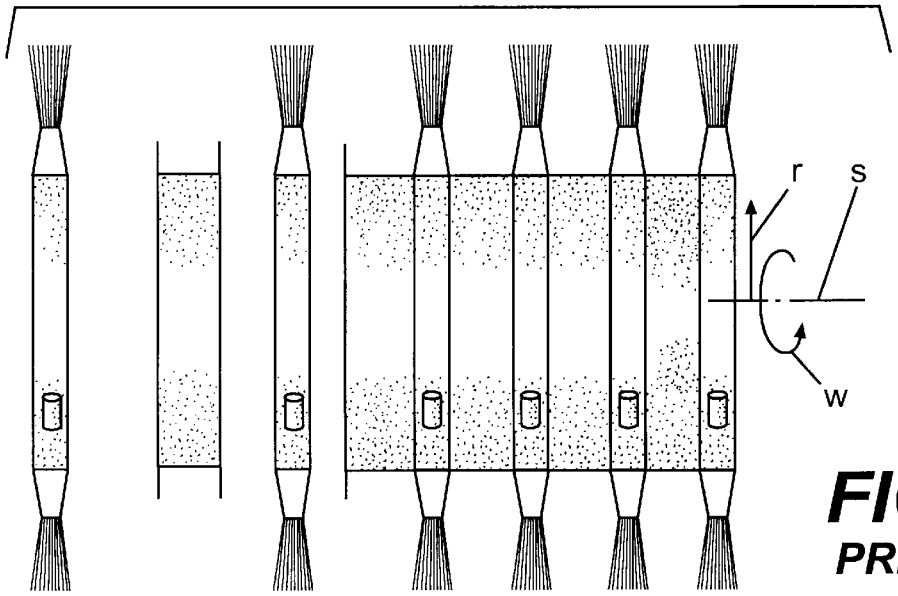
FIG. 1b PRIOR ART

The above has been explained with reference numbers particularly in FIG. 4, that shows a brush formed of advantageous brush rings according to the invention as a sectional side view. When comparing a brush formed of brush rings according to the invention and its functioning particularly with an ordinary brush as shown in FIGS. 1*a* and 1*b*, it may be noticed, that the brush ring according to the invention may be used in principle as long as an adequate brushing effect may still be acquired with the brushes. When coupling ordinary brush rings, space collars are always needed in principle between the brush rings placed one after another, which points out furthermore unsatisfactory functioning of usual plane shaped brush rings in such respect, that due to wearing of the brushes particularly with reference to FIG. 1*b* the contact surface brought out by the outer surface of the brush becomes very quickly uncontinuous. For example the brush shown in FIG. 1*b* would not be any more useable in most usual purposes and the brush as shown in FIG. 1*a* as well already nearly unsatisfactory in certain demanding purposes.

Figure 2:
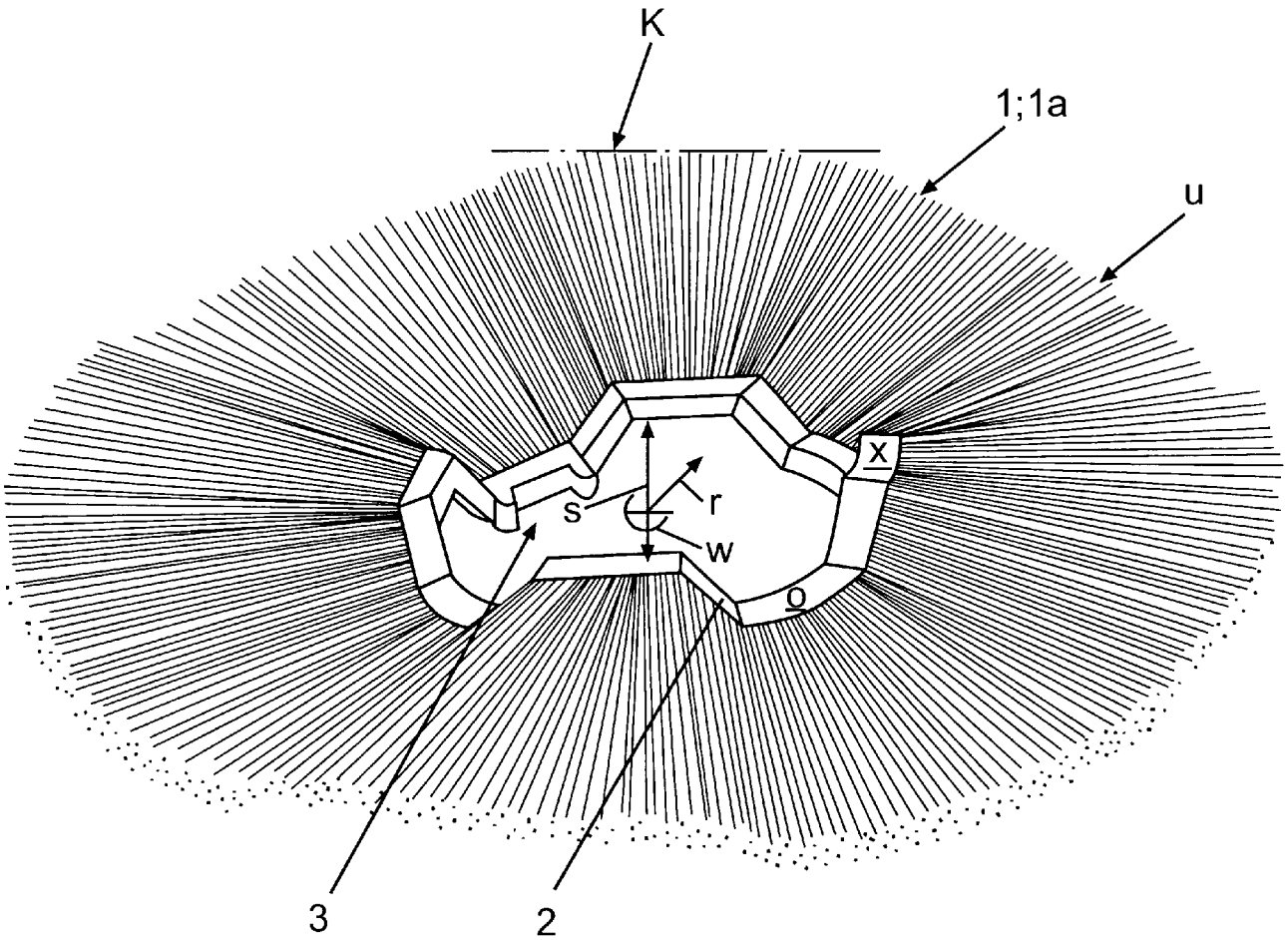
FIG. 2 shows an advantageous brush ring according to the present invention in a perspective view.
Figure 3:
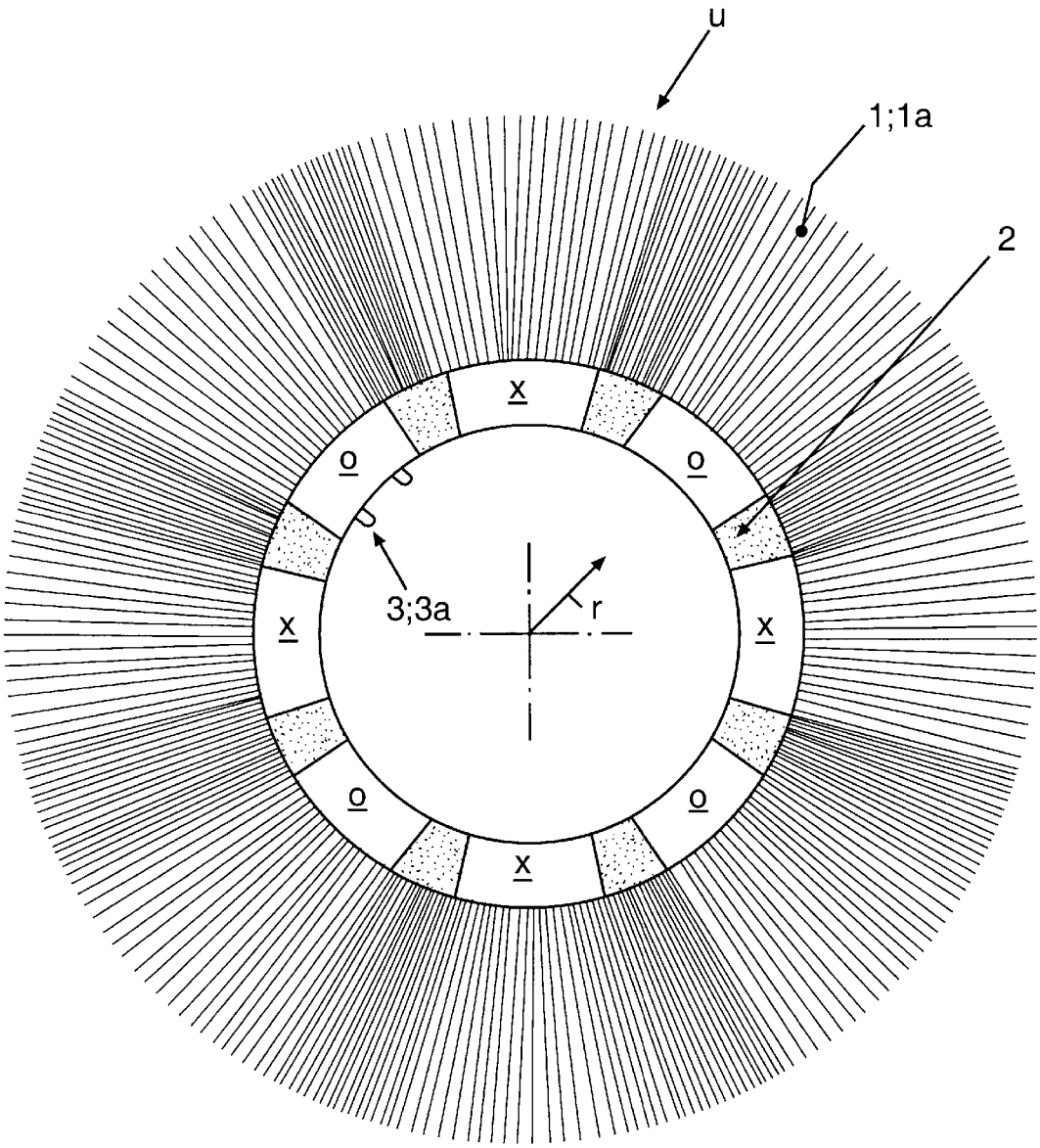
FIG. 3 shows the brush ring according to FIG. 2 viewed in a perpendicular direction with respect to the longitudinal direction of the brushes.
Figure 4:
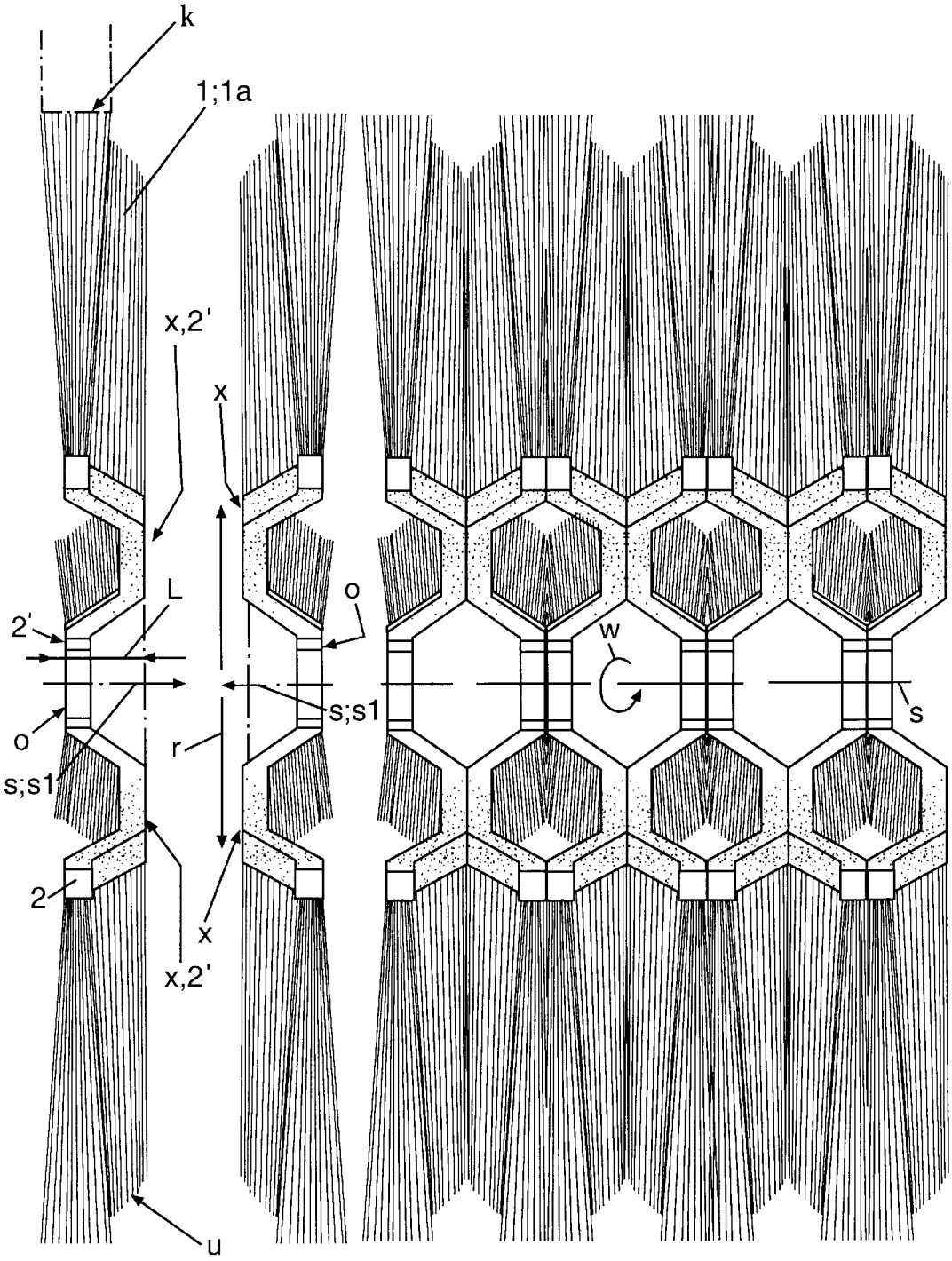
FIG. 4 shows a brush formed of the brush rings according to FIG. 2 as a sectional sideview.

With reference particularly to FIGS. 2, 3 and 4, the frame part 2 of the brush ring, in which the brush part 1 has been attached advantageously centrally and is arranged to extend with an essentially constant cross section (that may be noticed e.g. from FIG. 4), has been arranged to project sidewards from the ground level o of the same in four places x. Furthermore as an advantageous embodiment, the frame part 2 has been arranged to project sidewards from the ground level o only on one side s1 of the same.

Furthermore with reference particularly to e.g. FIGS. 2 and 4, the side surfaces 2', that are placed at the front and back edges of the frame part 2 and that are preferably directly in touch which the adjacent brush rings, are arranged essentially plane shaped.

Furthermore as an advantageous embodiment, the frame part 2 of the brush ring has been arranged as a structure, that is bent regularly and essentially rectilinearly sidewards s1, in which case the frame part 2 has been arranged to project sidewards sl from the ground level o of the same preferably at a sharp angle, such as at an angle of 45°. Thanks to the arrangement described above, it is first of all possible to collect a brush formed of brush rings according to the invention as shown in FIG. 4 by laying the successive brush rings to the attachment frame of the brushing machine alternatively as "the right way around" and "the opposite way around", in which case a cell-like structure is formed of the successive frame parts 2 as shown in FIG. 4. The above arrangement enables on the other hand that the brush rings may be bunched into a very tight pack e.g. for transportation, by collecting up all the brush rings the same way around on one another, in which case they are placed against each other from all over, thanks to which the need for space of the brush rings decreases significantly, when compared to the brush to be collected from the same.

It is obvious, that the invention is not limited to the embodiments presented or described above, but it can be modified within the basic idea even to a great extent. In this case it is first of all possible to form a brush ring according to the independent claim of a frame part, that is e.g. wider than presented and in which there has been attached e.g. one single spiral- shaped brushing or, that has been carried out by means of a two or multiple ended threading. It is also possible to exploit the principle described above on the other hand by using a solution like the one shown in the drawings, in which the frame part comprises a structure, that has e.g. knees extending sidewards instead of a structure having a cross section, that extends constant. It is also possible to equip the brush rings according to the invention with holding arrangements, functioning by means of e.g. male-female-principle and that are placed at the axially directed side surfaces of the frame parts of the same. It is naturally possible to produce a brush ring according to the invention of most heterogeneous materials, by exploiting most heterogeneous manufacturing methods, in which case use of polypropylene as the manufacturing material of the brush rings has been represented as one example, only, that is, however, a very suitable alternative in this connection.

What is claimed is:

1. A brush ring comprising:

a brush part formed from radially directed brushes;

a ring shaped frame part connecting the brushes, the frame part having a surface extending circumferentially with respect to said ring shape and the radial direction of the brushes being substantially perpendicular to said circumferential surface, and the frame part comprising at least two projecting portions extending sidewards from a ground level of the frame part, wherein the brush part and the frame part are formed as a single piece from recyclable material; and, a holding means associated with the frame part for preventing the brush ring from twisting when it is assembled in a brushing machine with other brush rings placed one after another in a longitudinal direction of a rotational axis of the brushing machine, such that a touching point of an outer circle of the brush part changes within a breadth of the brush ring to achieve an unbroken brush touch in the longitudinal direction of the brushing machine.

2. A brush ring according to claim 1, wherein the brush part of the brush ring, is centrally attached on said circumferential surface of the frame part, and the frame part has an essentially constant cross section.

3. A brush ring according to claim 1, wherein the projecting portions of the frame part have been arranged to project sidewards on one side from the ground level.

4. A brush ring according to claim 1, wherein the projecting portions of the frame part have been arranged to project sidewards in at least three places.

5. A brush ring according to claim 1, wherein part of said projecting portions are placed at front and back edges of the frame part, when viewed in the longitudinal direction of the brushing machine, and said projecting portion parts are directly in touch with the adjacent brush rings and are essentially plane shaped.

6. A brush ring according to claim 1, wherein the frame part of the brush ring has been arranged as a structure that is bent regularly and essentially rectilinearly sidewards.

7. A brush ring according to claim 6, wherein the frame part has been arranged to project sidewards from the ground level of the frame part at a sharp angle.

8. A brush ring according to claim 7, wherein the sharp angle is about 45 degrees.

9. A brush ring according to claim 1, wherein the frame part has four projecting portions.

10. A brush ring according to claim 1, wherein the recyclable material comprises polypropylene.

* * * * *